US007766697B2

(12) United States Patent
Matsumura et al.

(10) Patent No.: US 7,766,697 B2
(45) Date of Patent: Aug. 3, 2010

(54) CONNECTOR

(75) Inventors: Kaoru Matsumura, Makinohara (JP); Akihiro Tsuruta, Fujieda (JP)

(73) Assignee: Yazaki Corporation, Tokyo (JP)

( * ) Notice: Subject to any disclaimer, the term of this patent is extended or adjusted under 35 U.S.C. 154(b) by 70 days.

(21) Appl. No.: 12/269,246

(22) Filed: Nov. 12, 2008

(65) Prior Publication Data

US 2009/0142958 A1 Jun. 4, 2009

(30) Foreign Application Priority Data

Nov. 16, 2007 (JP) ..... 2007-297525

(51) Int. Cl.
*H01R 13/40* (2006.01)

(52) U.S. Cl. ..... 439/595

(58) Field of Classification Search ..... 439/595, 439/347, 752, 871, 271–275
See application file for complete search history.

(56) References Cited

U.S. PATENT DOCUMENTS

| | | | | |
|---|---|---|---|---|
| 5,782,657 | A * | 7/1998 | Wolla et al. | 439/595 |
| 6,805,592 | B2 * | 10/2004 | Kurimoto | 439/752 |
| 6,835,102 | B2 * | 12/2004 | Kayama | 439/686 |
| 7,488,221 | B2 * | 2/2009 | Tanaka et al. | 439/752 |
| 2002/0102877 | A1 * | 8/2002 | Nankou | 439/595 |
| 2002/0127913 | A1 * | 9/2002 | Ichio | 439/595 |
| 2003/0207616 | A1 * | 11/2003 | Nishide | 439/595 |
| 2008/0009186 | A1 * | 1/2008 | Hiramatsu | 439/595 |

FOREIGN PATENT DOCUMENTS

| | | | |
|---|---|---|---|
| JP | 2000-036352 | A | 2/2000 |
| JP | 2001-155811 | A | 6/2001 |
| JP | 2002-343483 | A | 11/2002 |
| JP | 2002-373725 | A | 12/2002 |
| JP | 2003-007390 | A | 1/2003 |
| JP | 2004-200074 | A | 7/2004 |
| JP | 2004-288443 | A | 10/2004 |

* cited by examiner

*Primary Examiner*—Jean F Duverne
(74) *Attorney, Agent, or Firm*—Sughrue Mion, PLLC

(57) ABSTRACT

Retaining projections are formed on and project outwardly in a right-left direction respectively from right and left side walls of a spacer. The retaining projections are used for achieving a provisionally-retained condition and a completely-retained condition of the spacer. When the side walls are elastically deformed, the retaining projections slide over respective retaining portions of a connector housing to thereby achieve the retained condition. The side walls which can be elastically deformed inwardly in the forward-rearward direction form portions of right and left outermost terminal passage holes, and therefore must hold respective metal terminals, respectively. Therefore, holding projections are formed on and project inwardly in the right-left direction respectively from the side walls. These terminal holding projections serve to hold the respective metal terminals in predetermined positions.

2 Claims, 4 Drawing Sheets

CONNECTOR

BACKGROUND

This invention relates to a connector provided with a spacer for retaining metal terminals (received in a connector housing) in a double manner.

A related connector includes a connector housing having a plurality of terminal receiving chambers, and metal terminals received respectively in the terminal receiving chambers, and each terminal receiving chamber has a lance formed integrally on an inner surface thereof. When the metal terminal is received in the terminal receiving chamber, the lance retains this metal terminal against withdrawal.

However, in recent years, with the advance of a multi-pole design of connectors, a sufficient retaining force to retain a metal terminal can not be provided only by a lance, and therefore there has been adopted a structure in which a spacer separate from a connector housing is attached to the connector housing so as to retain the metal terminals in a double manner (see, for example, Patent Literature 1).

[Patent Literature 1] JP-A-2000-36352

The related connector disclosed in Patent Literature 1 has a problem that the thickness of the spacer in a direction of extending of terminal receiving chambers (that is, in a forward-rearward direction of the connector housing) is increased. The spacer is adapted to be mounted in a spacer mounting hole (formed in the connector housing) first in a provisionally-retained condition and then in a completely-retained condition. Therefore, the spacer need to include retaining projections for achieving the provisionally-retained condition and the completely-retained condition, and bending spaces for allowing the elastic deformation (or bending) of those portions of the spacer having the retaining projections, and as a result of formation of these portions, the thickness of the spacer is increased accordingly.

In recent years, connectors have been more and more required to have a compact design and a space-saving design, and when the thickness of the spacer is large, it is difficult to meet this requirement, and therefore the inventor of the present invention thought it necessary to improve the structure of the spacer.

SUMMARY

This invention has been made in view of the above circumstances, and an object of the invention is to provide a connector which can have a compact design and a space-saving design.

In order to achieve the above object, according to the present invention, there is provided a connector comprising:

a connector housing which has a plurality of terminal receiving chambers juxtaposed in a first direction, the terminal receiving chambers being extending in a second direction perpendicular to the second direction, and the connector having a spacer mounting hole which extends across the terminal receiving chambers and opens to a lower surface of the connector housing;

metal terminals which are received and retained respectively in the terminal receiving chambers; and a spacer which is mounted in the spacer mounting hole so as to be provisionally retained or completely retained relative to the connector housing, wherein the spacer has a plurality of terminal passage holes extending in the second direction so that the terminal passage holes are aligned with the terminal receiving chambers;

wherein the spacer has a pair of right and left side walls which define portions of the right and left outermost terminal passage holes respectively, and the terminal passage holes are separated from one another by passage hole partition walls;

wherein a pair of retaining projections are formed on and project outwardly in the first direction respectively from the side walls, and a pair of terminal holding projections are formed on and project inwardly in the first direction respectively from the side walls;

wherein each of the right and left side walls has a projection formation portion on which the retaining projection and the holding projection are formed, and each of the projection formation portions has elasticity so as to be elastically deformed inwardly in the first direction within the range of a space formed by a groove formed in vicinity of an inner side of a root portion of the side wall; and wherein a width of each of the right and left outermost terminal passage holes between the corresponding side wall and the adjoining passage hole partition wall is greater than a width of each of inner terminal passage holes between the adjacent passage hole partition walls, and a width between the terminal holding projection and the passage hole partition wall of each of the right and left outermost terminal passage holes is substantially equal to the width of each of the inner terminal passage holes, the inner terminal passage holes disposed between the right and left outermost terminal passage holes.

By the above configuration, without increasing the thickness of the spacer (that is, the length of the spacer in the forward-rearward direction), the spacer can be positively provisionally and completely retained relative to the connector housing.

More specifically, the retaining projections are formed on and project outwardly in the first direction (right-left direction) respectively from the right and left side walls of the spacer. The retaining projections are used for achieving the provisionally-retained condition and the completely-retained condition of the spacer. When the side walls are elastically deformed, the retaining projections slide over respective retaining portions of the connector housing to thereby achieve the retained condition. The side walls (which can be elastically deformed inwardly in the right-left direction) form portions of the right and left outermost terminal passage holes, and therefore must hold the respective metal terminals. Therefore, the holding projections are formed on and project inwardly in the first direction respectively from the side walls. These terminal holding projections serve to hold the respective metal terminals in predetermined positions.

The width of each outermost terminal passage hole between the side wall and the adjoining passage hole partition wall and the width dimension between the terminal holding projection and the passage hole partition wall of each outermost terminal passage hole are suitably determined, and the side walls can be elastically deformed, and the terminal holding projections are formed. With this construction, there can be obtained the spacer which will not extend too long in the forward-rearward direction. Thanks to the above features of the spacer, the compact design and space-saving design of the connector can be achieved.

The amount of projecting of the retaining projections (which project outwardly in the right-left direction) and the amount of elastic deformation of the side walls can be sufficiently absorbed by reducing part of each side wall of the connector housing.

Preferably, the retaining projection on each side wall is disposed closer to the groove than the holding projection.

By the above configuration, each retaining projection is disposed closer to the groove, the side walls can be sufficiently elastically deformed even in a condition in which the metal terminals are inserted in the spacer. In the invention, the spacer can be easily brought into the provisionally-retained condition and the completely-retained condition.

By the above configurations, the connector is provided with the spacer which is not increased in the forward-rearward direction, and therefore there is achieved an advantage that the compact design and space-saving design of the connector can be achieved.

By the above configurations, the arrangement of the retaining projection, the terminal holding projection and the groove of each side wall is suitably determined, and by doing so, there is achieved an advantage that the spacer can be provisionally and completely retained more easily without affecting the metal terminals.

BRIEF DESCRIPTION OF THE DRAWINGS

The above objects and advantages of the present invention will become more apparent by describing in detail preferred exemplary embodiments thereof with reference to the accompanying drawings, wherein:

FIG. 1A is a cross-sectional view of a spacer in a completely-retained condition, FIG. 1B is a front-elevational view of the spacer, and FIG. 1C is a cross-sectional view of a spacer in a provisionally-retained condition of the spacer;

DETAILED DESCRIPTION OF EXEMPLARY EMBODIMENTS

Figure 1A:
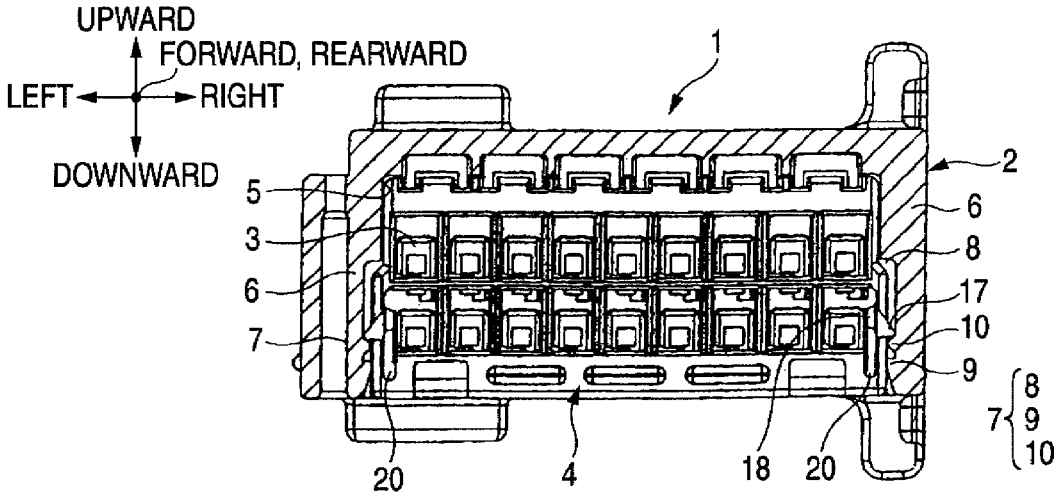
FIGS. 1A to 1C are cross-sectional views of a connector of an embodiment according to the present invention.
Figure 1B:
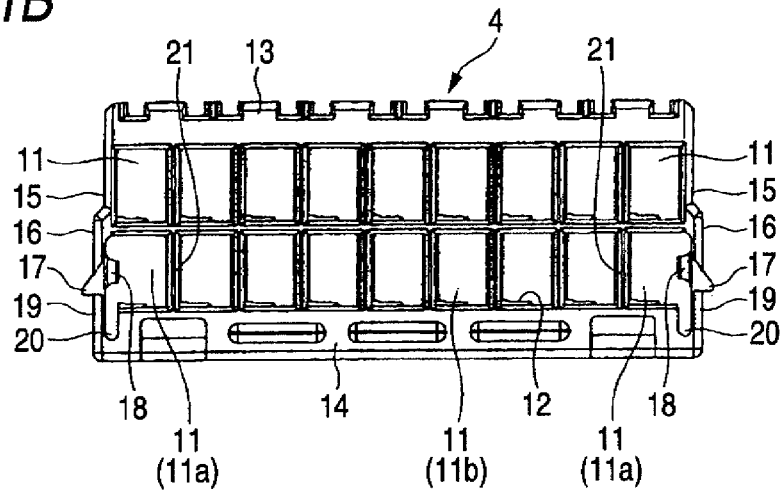
Figure 1C:
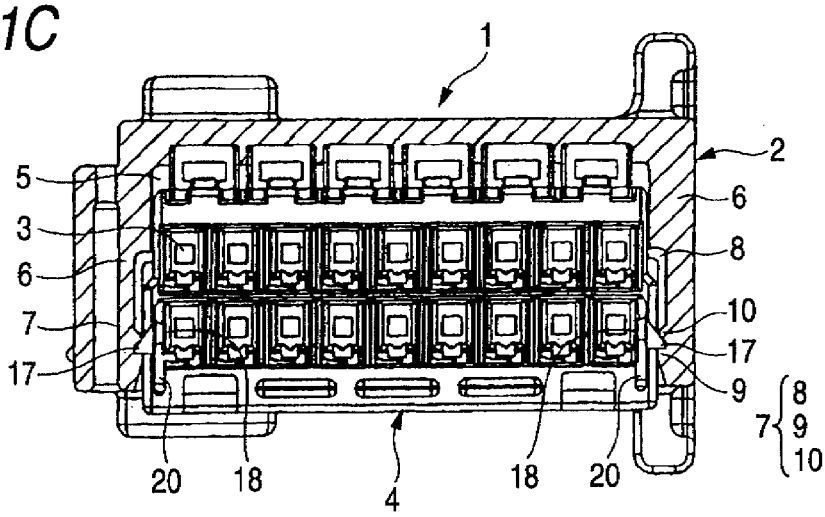
Figure 2:
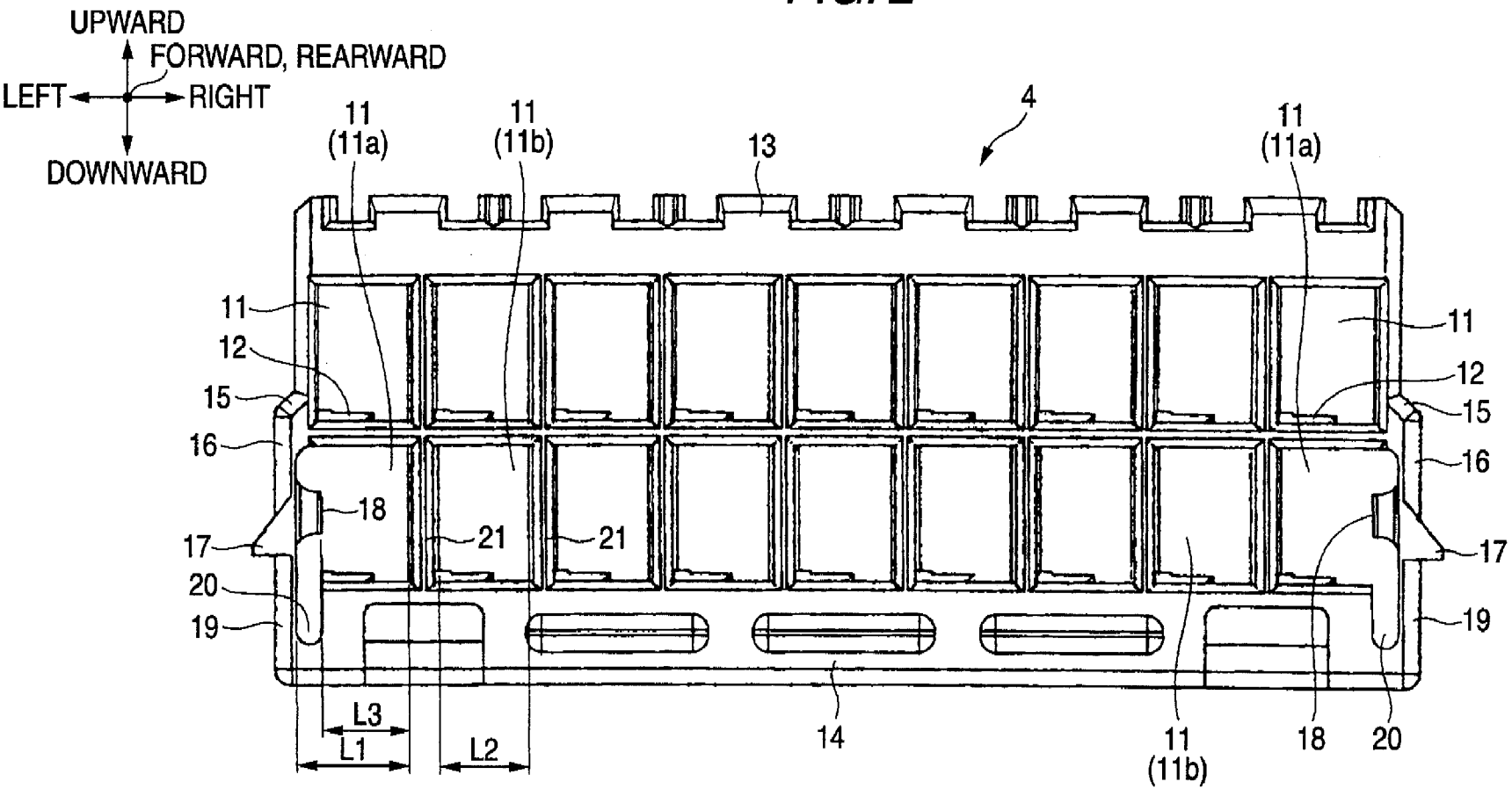
FIG. 2 is an enlarged front-elevational view of the spacer.
Figure 3:
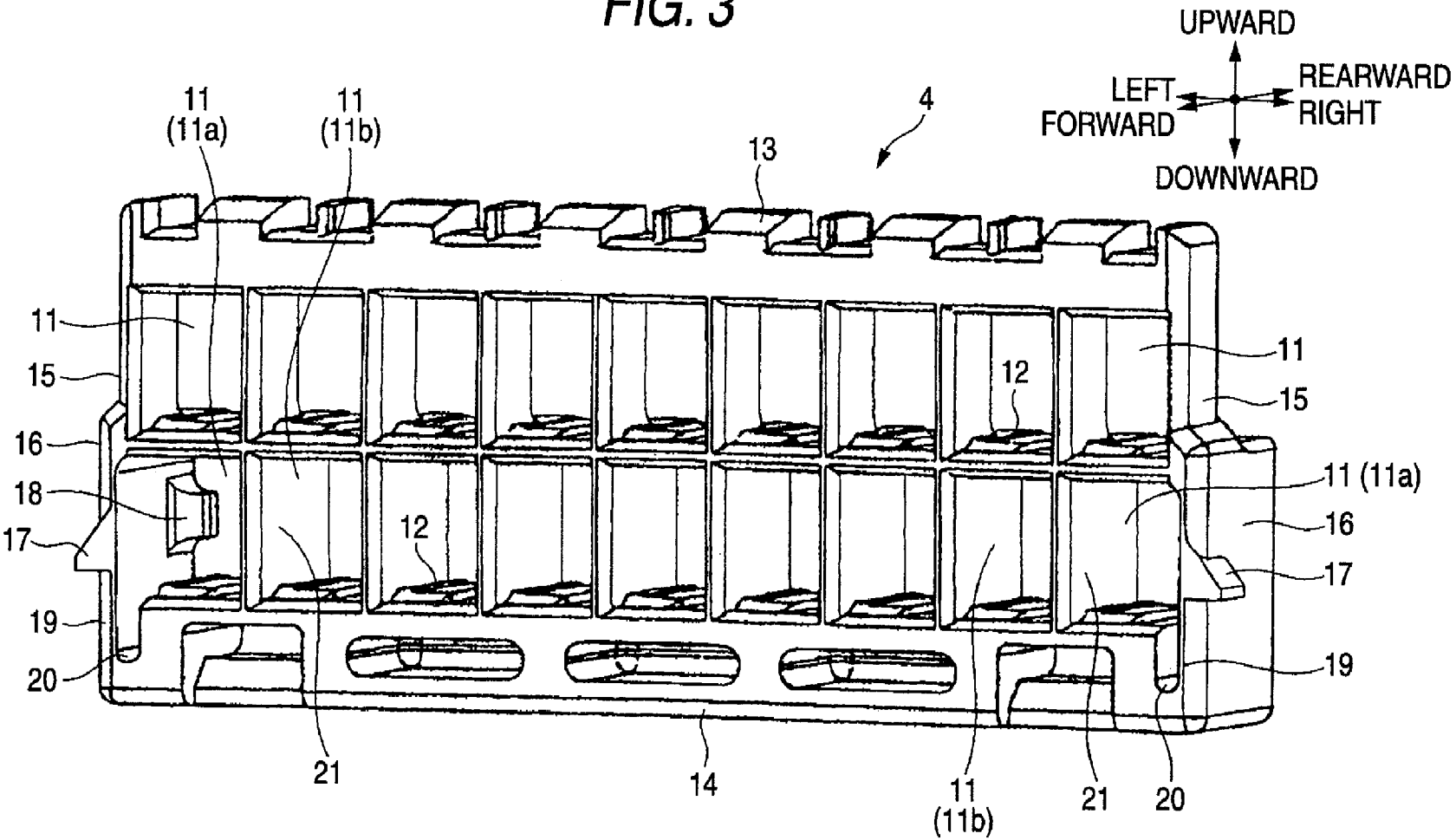
FIG. 3 is an enlarged perspective view of the spacer.
Figure 4:
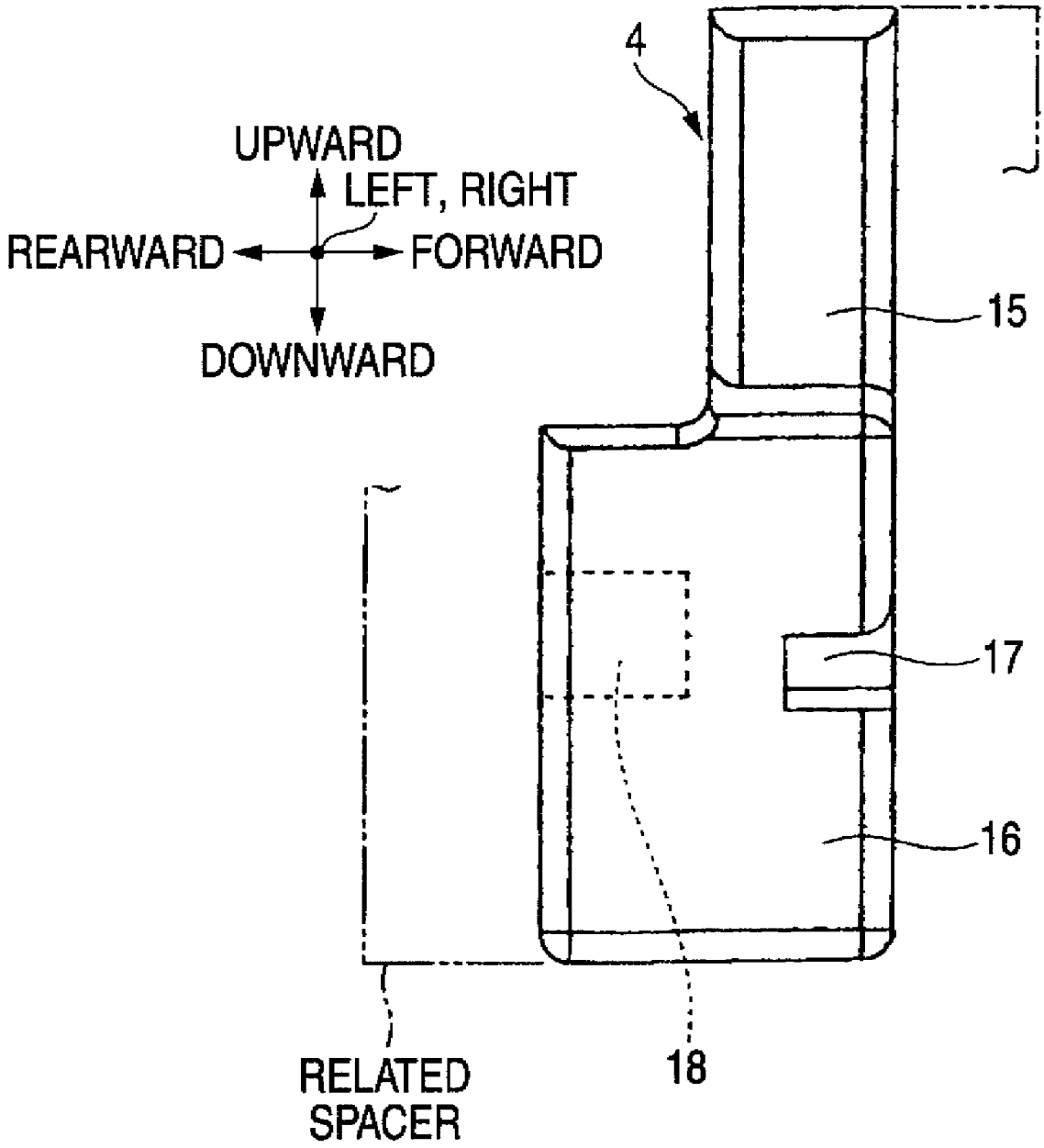
FIG. 4 is an enlarged side-elevational view of the spacer.

A preferred embodiment of the present invention will now be described with reference to the drawings. FIGS. 1A to 1C are cross-sectional views of a connector of an embodiment according to the invention. FIG. 1A is a cross-sectional view of a spacer in a completely-retained condition, FIG. 1B is a front-elevational view of the spacer, and FIG. 1C is a cross-sectional view of a spacer in a provisionally-retained condition of the spacer. FIG. 2 is an enlarged front-elevational view of the spacer, FIG. 3 is an enlarged perspective view of the spacer, and FIG. 4 is an enlarged side-elevational view of the spacer.

In FIGS. 1A to 1C, the connector 1 comprises a connector housing 2 made of an insulative synthetic resin and having a plurality of terminal receiving chambers 3, a plurality of metal terminals (not shown) received and retained respectively in the terminal receiving chambers 3, and the spacer 4 for retaining the metal terminals in a double manner.

In this connector 1, the spacer 4 shown in FIG. 1B is attached to the connector housing 2 to be disposed in its provisionally-retained condition as shown in FIG. 1C, and in this provisionally-retained condition the metal terminals are inserted respectively into the terminal receiving chambers 3, and then the spacer 4 is brought into the completely-retained condition as shown in FIG. 1A, so that the mounting of this spacer 4 in the connector housing 2 is completed.

Known female metal terminals having electrical conductivity are used as the metal terminals (not shown), and therefore description thereof will be omitted here. In the following description, arrows in the drawings indicate an upward-downward direction and a right-left direction. In FIGS. 1A, 1B, 1C and 2, a direction perpendicular to the sheet of these Figures defines a forward-rearward direction (The front side of the sheet defines the forward direction, while the rear side of the sheet defines the rearward direction.).

The terminal receiving chambers 3 are formed in the connector housing 2, and extend straight in the forward-rearward direction. The terminal receiving chambers 3 are arranged in two (upper and lower) rows, and are juxtaposed in the right-left direction. Lances, although not designated by a reference numeral, are formed integrally respectively on front portions of the terminal receiving chambers 3. Each lance has a cantilever-like shape so as to retain the metal terminal inserted into the terminal receiving chamber.

The connector housing 2 has a spacer mounting hole 5 for the mounting of the spacer 4 therein. This spacer mounting hole 5 is formed in the connector housing 2, and extends through a lower wall thereof, and hence is open to the lower surface of the connector housing 2. The spacer mounting hole 5 extends across the plurality of terminal receiving chambers 3. Those portions of opposite (right and left) side walls 6 of the connector housing 2 corresponding to the spacer mounting hole 5 are reduced in thickness to form retaining portions 7 for the spacer 4.

The retaining portion 7 includes a space 8 formed as a result of reducing the thickness of the side wall 6, a provisionally-retaining portion 9, and a completely-retaining portion 10, the two retaining portions 9 and 10 being disposed near to the lower wall of the connector housing 2. The provisionally-retaining portion 9 as well as the completely-retaining portion 10 has a mountain-like shape (that is, has a generally triangular cross-section), and when each retaining projection (described later) of the spacer 4 fits in a valley portion, the retained condition is achieved. The provisionally-retaining portion 9 is disposed closer to the lower wall of the connector housing 2 than the completely-retaining portion 10.

In FIGS. 1A to 4, the spacer 4 has a plurality of terminal passage holes 11 extending therethrough in the forward-rearward direction such that these terminal passage holes 11 can be aligned with the terminal receiving chambers 3 of the connector housing 2 (The terminal passage holes 11 are arranged in two (upper and lower) rows, and are juxtaposed in the right-left direction.). The spacer 4 comprises a rectangular frame-like member, and has a minimum thickness (width or dimension in the forward-rearward direction) necessary for the formation of the terminal passage holes 11.

Each terminal passage hole 11, when viewed from the front side, has a generally rectangular shape, and a retaining portion 12 is formed at a lower or bottom portion of each terminal passage hole 11. In the completely-retained condition of the spacer 4, this retaining portion 12 is engaged with the metal terminal to retain the same in a double manner.

The spacer 4 includes an upper wall 13, a lower wall 14, and opposite (right and left) side walls 15. Part of each side wall 15 is formed as a projection formation portion 16 (which will be described later). The projection formation portions 16 are disposed in agreement with the lower row of terminal passage holes 11. The right and left outermost ones of the lower row of terminal passage holes 11 are designated by reference numeral 11*a*, while those terminal passage holes 11 (hereinafter referred to as "inner terminal passage holes) disposed between the right and left outermost terminal passage holes 11*a* are designated by reference numeral 11*b*. The upper row of terminal passage holes 11 each has the same shape as that of the inner terminal passage hole 11*b*.

The right and left side walls 15 (the projection formation portions 16) of the spacer 4 define side walls of the right and left outermost terminal passage holes 11*a*, respectively. A pair of retaining projections 17 are formed on and project outwardly in the right-left direction respectively from the right and left side walls 5. Also, a pair of terminal holding projections 18 are formed on and project inwardly in the right-left direction respectively from the right and left side walls 5. Each side wall 15 has a groove 20 formed in contiguous relation to an inner side of a root portion 19 thereof. Each side wall 15 has such elasticity as to be elastically deformed (or bent) inwardly in the right-left direction within the range of a space formed by the groove 20. In this embodiment, that portion of the side wall 15 having the retaining projection 17 and the terminal holding projection 18 is referred to as the projection formation portion 16 so that this portion can be easily distinguished from the other portion of the side wall 15 with no such projections when a plurality of rows terminal passage holes 11 are provided as in this embodiment.

The pair of retaining projections 17 serve as portions for provisionally and completely retaining the spacer 4 relative to the spacer mounting hole 5 of the connector housing 2. When each side wall 15 is elastically deformed (or bent), the retaining projection 17 slides over the provisionally-retaining portion 9 (or the completely-retaining portion 10), and fits into the adjoining valley portion to be retainingly engaged therein. With this retaining engagement, the spacer 4 can be provisionally retained and can be completely retained.

The terminal holding projection 18 is formed for holding the metal terminal in a predetermined position relative to the corresponding side wall 15. A distal end of the terminal holding projection 18 has such a shape as to be brought into surface-to-surface contact with an electrical contact portion of the metal terminal to thereby hold the metal terminal in the predetermined position. The terminal holding projection 18 is slightly offset upwardly from the retaining projection 17, and is spaced from the groove 20. Also the terminal holding projection 18 is slightly offset rearwardly from the retaining projection 17.

In FIG. 2, a width L1 of each outermost terminal passage hole 11*a* between the side wall 15 and an adjoining passage hole partition wall 21 is larger than a width L2 of each inner terminal passage hole 11*b* between adjacent passage hole partition walls 21. Also, a width dimension L3 between the terminal holding projection 18 and the passage hole partition wall 21 of the outermost terminal passage hole 11*a* is generally equal to the width L2 of the inner terminal passage hole 11*b*.

As described above with reference to FIGS. 1A to 4, in the present invention, without increasing the thickness of the spacer 4 (that is, the length of the spacer 4 in the forward-rearward direction), the spacer 4 can be positively provisionally and completely retained relative to the connector housing 2. Therefore, the connector 1 of the invention provided with the spacer 4 of the above construction is more advantageous in the compact design and the space-saving design over the related connectors (The dimension of the spacer of the invention in the forward-rearward direction is sufficiently reduced as compared with a related spacer indicated by dots-and-dash lines in FIG. 4.).

The present invention is not limited to the above embodiment, and various modifications can be made without departing from the subject matter of the invention.

The present application is based on Japan Patent Application No. 2007-297525 filed on Nov. 16, 2008, the contents of which are incorporated herein for reference.

What is claimed is:

1. A connector comprising:

a connector housing which has a plurality of terminal receiving chambers juxtaposed in a first direction, the terminal receiving chambers being extending in a second direction perpendicular to the second direction, and the connector having a spacer mounting hole which extends across the terminal receiving chambers and opens to a lower surface of the connector housing;

metal terminals which are received and retained respectively in the terminal receiving chambers; and a spacer which is mounted in the spacer mounting hole so as to be provisionally retained or completely retained relative to the connector housing, wherein the spacer has a plurality of terminal passage holes extending in the second direction so that the terminal passage holes are aligned with the terminal receiving chambers;

wherein the spacer has a pair of right and left side walls which define portions of the right and left outermost terminal passage holes respectively, and the terminal passage holes are separated from one another by passage hole partition walls;

wherein a pair of retaining projections are formed on and project outwardly in the first direction respectively from the side walls, and a pair of terminal holding projections are formed on and project inwardly in the first direction respectively from the side walls;

wherein each of the right and left side walls has a projection formation portion on which the retaining projection and the holding projection are formed, and each of the projection formation portions has elasticity so as to be elastically deformed inwardly in the first direction within the range of a space formed by a groove formed in vicinity of an inner side of a root portion of the side wall; and wherein a width of each of the right and left outermost terminal passage holes between the corresponding side wall and the adjoining passage hole partition wall is greater than a width of each of inner terminal passage holes between the adjacent passage hole partition walls, and a width between the terminal holding projection and the passage hole partition wall of each of the right and left outermost terminal passage holes is substantially equal to the width of each of the inner terminal passage holes, the inner terminal passage holes disposed between the right and left outermost terminal passage holes.

2. The connector according to claim 1, wherein the retaining projection on each side wall is disposed closer to the groove than the holding projection.

* * * * *